US008258908B2

(12) United States Patent
Liao et al.

(10) Patent No.: US 8,258,908 B2
(45) Date of Patent: Sep. 4, 2012

(54) TRANSFORMER AND METHOD OF MAKING THE SAME

(75) Inventors: Kao-Tsai Liao, Taoyuan Hsien (TW); Hsi-Kuo Chung, Taoyuan Hsien (TW); Ming-Shian Peng, Taoyuan Hsien (TW); Yu-Liang Hung, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 157 days.

(21) Appl. No.: 12/948,570

(22) Filed: Nov. 17, 2010

(65) Prior Publication Data

US 2011/0115593 A1 May 19, 2011

(30) Foreign Application Priority Data

Nov. 18, 2009 (TW) ..... 98139221 A

(51) Int. Cl.
*H01F 27/02* (2006.01)
*H01F 27/29* (2006.01)

(52) U.S. Cl. ..... 336/90; 336/83; 336/192; 336/198

(58) Field of Classification Search ..... 336/83, 336/192, 198
See application file for complete search history.

(56) References Cited

U.S. PATENT DOCUMENTS 5,977,855 A * 11/1999 Matsumura et al. ..... 336/96
6,078,240 A * 6/2000 Huang ..... 336/90
7,528,694 B2 * 5/2009 Tseng et al. ..... 336/212
8,054,152 B2 * 11/2011 Tseng et al. ..... 336/192

* cited by examiner

*Primary Examiner* — Mohamad Musleh
*Assistant Examiner* — Ronald Hinson
(74) *Attorney, Agent, or Firm* — Kirton McConkie; Evan R. Witt

(57) ABSTRACT

A transformer and a method of manufacturing the same are disclosed. The transformer comprises a magnetic core, a winding coil with a primary winding coil and a secondary winding coil, a bobbin with a primary input port and a bobbin connecting member, and an insulating slipcase. The bobbin is mounted by the winding coil. The insulating slipcase includes a first opening to receive the magnetic core, the winding coil and the bobbin, and includes a first side wall, a second side wall with a slipcase connecting member which is engaged with the bobbin connecting member, and a secondary output port for dealing with the output of the transformer. The first side wall is opposite to the first opening and has a second opening for the output of the secondary winding coil.

19 Claims, 5 Drawing Sheets

TRANSFORMER AND METHOD OF MAKING THE SAME

FIELD OF THE INVENTION

The present invention relates to a transformer and a method of making the same; and more particularly to a transformer with an increased electrical insulation, and a method of making the same.

BACKGROUND OF THE INVENTION

A transformer is a key component for a wild variety of electronic devices. The most pressing problems facing the industry will be the safety issue, especially when the design trend of electronic devices tends to reduce the device size and cost. As a matter of fact, the components inside various electronic devices are placed in high density nowadays.

In general, a conventional transformer would comprise a winding coil, a magnetic core, and a bobbin mounted by the winding coil. As shown in FIGS. 1 and 2, they are an exploded view and an assembled view of a conventional transformer. The transformer 10 is constructed by the combination of the magnetic core 11 and the bobbin 31 which is mounted by the winding coil 21. As illustrated, the construction to assemble the magnetic core 11 with the bobbin 31 is done through the combination between a central post 111 of the magnetic core 11 and a perforation channel 313 of the bobbin 31. The perforation channel 313 provides room to accommodate the central post 111.

As shown, a primary input port 311 and a secondary output port 417 are both placed on the bobbin 31 and extended outward from two opposite sides of the bobbin 31. The assembled transformer 10 appears just a bit larger than the magnetic core 11 since the bobbin 31 extend a bit outward for receiving power by the primary input port 311 and supplying power by the secondary output port 417. However, the assembled transformer 10 and the magnetic core 11 are tempted to be designed of almost the same size by the recent trend. This design is to spare more room for an electronic device to accommodate more components within a limited space under the high density condition.

On the other hand, the conventional transformer as illustrated in FIGS. 1 and 2 also suggests a safety issue arising from the same construction, since the exposed portion of the magnetic core 11 open to the outside space is so close to other components which are disposed nearby (not shown). In other words, this would certainly cause extra efforts to improve and verify the insulating of the transformer 10 so as to prevent from any serious electrical safety issue. As well known in the art, to seal the exposed portion of the magnetic core 11 by an insulating tape or an adhesive tape (not shown) is the most common way to solve the foregoing problem. It is a simple idea to separate two conductive parts from each other by attaching a sticky tape to either one or both of them. Nevertheless, the insulating results can vary and be unstable. For example, it depends upon the material of the tape, the finishing jobs in fabricating, and the condition in use.

Accordingly, several disadvantages emerge. While in fabricating, it is easily to be understood that such transformers would require paying more attention to the security of the insulating tape. Especially, the exposed portion is quite huge and the insulating tape is required to be attached and secured by hand in normal cases. Even though the tape has been attached precisely right to the required portion, the security of the tape can fail at any time resulting from inadvertently move or touch conducted by the worker during the assembly.

Besides, the security of the insulting tape may come to be unstable over time. Following inspections are thus crucial and necessary all the time. Also, it appears that the conventional transformers may not be suitable for the use of the electronic devices which are under the high density design. Likewise, the traditional way has shown that more risks might arise while such transformers are for the use with a portable electronic device. As known, it is the nature of a portable device that any kind of unexpected collisions against the device can be reasonably expected in advance. The collision accidents may cause the components inside becoming, for example, loose or distortion, and may directly result in a breaking of the insulating which may lead to serious electrical safety issues.

Apparently, a transformer which is of simple construction and capable to meet the needs for increasing more safety in use and reducing costs in fabricating are in demand.

SUMMARY OF THE INVENTION

It is an object of an embodiment of the present invention to provide a transformer and a method of making the same in which the transformer has an improved insulator to separate the transformer, and especially the magnetic core, from other components so that the electrical safety of the transformer is capable to be more firmly secured.

It is another object of an embodiment of the present invention to provide a transformer and a method of making the same in which the transformer has an improved insulating case to protect the magnetic core from short circuit risk in collision accidents so that the stability of the electrical safety of the transformer is capable to be increased.

It is another object of an embodiment of the present invention to provide a transformer and a method of making the same in which the transformer is of simple construction and has an improved insulating slipcase engaged with the bobbin so that the fabrication work of the transformer is easier and the costs are lower.

In accordance with an aspect of the present invention, there is provided a transformer. The transformer comprises a magnetic core, a winding coil with a primary winding coil and a secondary winding coil, a bobbin with a primary input port and a bobbin connecting member, and an insulating slipcase. The bobbin is mounted by the winding coil. The insulating slipcase includes a first opening to receive the magnetic core, the winding coil and the bobbin, and includes a first side wall, a second side wall with a slipcase connecting member which is engaged with the bobbin connecting member, and a secondary output port for dealing with the output of the transformer. The primary input port is for receiving the power and the secondary output port is for supplying the power. The first side wall is opposite to the first opening and has a second opening for the output of the secondary winding coil. In one embodiment, the transformer is placed on a circuit board, and the two ports are respectively connected to the same. The insulating slipcase is engaged with the bobbin through the engagement between the slipcase connecting member and the bobbin connecting member.

In accordance with an aspect of the present invention, there is provided a method of manufacturing a transformer. The method includes the forming of a winding coil with a primary winding coil and a secondary winding coil, a bobbin with a primary input port and a bobbin connecting member, and an insulating slipcase with a first opening, a first side wall, a second side wall with a slipcase connecting member, and a secondary output port. The first side wall is opposite to the first opening and has a second opening for the output of the secondary winding coil. The method also requires placing the winding coil around the bobbin, incorporating the bobbin with a magnetic core, accommodating the magnetic core, the winding coil, and the bobbin in the insulating slipcase through the first opening, and engaging the slipcase connecting member with the bobbin connecting member.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
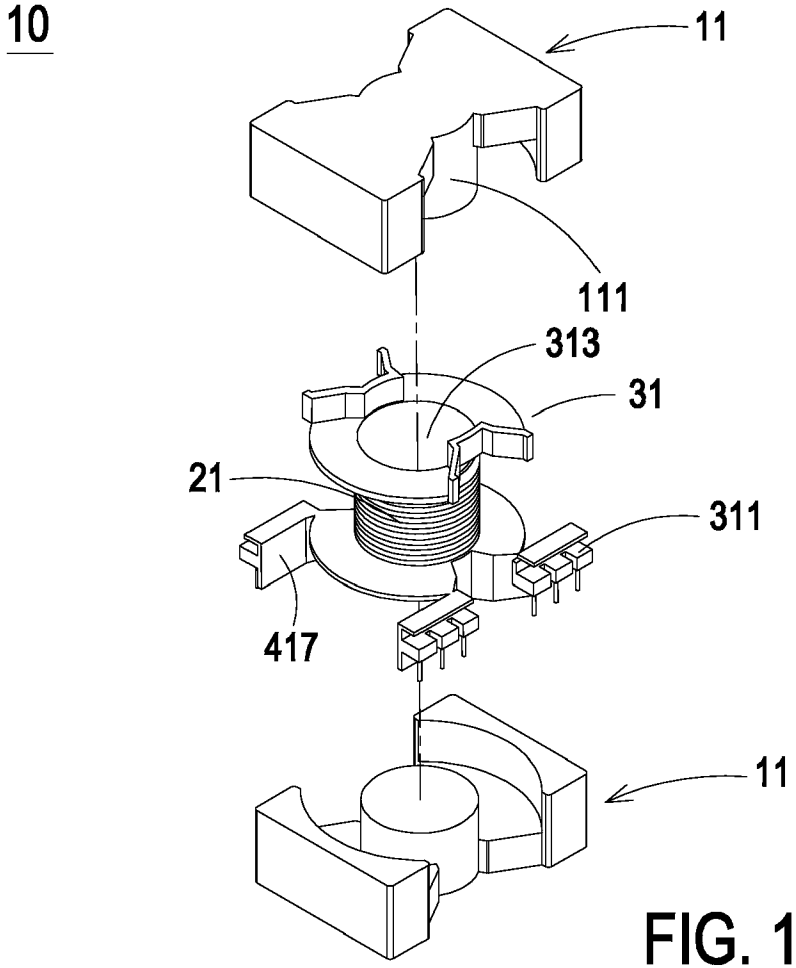
FIG. 1 PRIOR ART
FIG. 1 is an exploded view schematically showing a conventional transformer.
Figure 2:
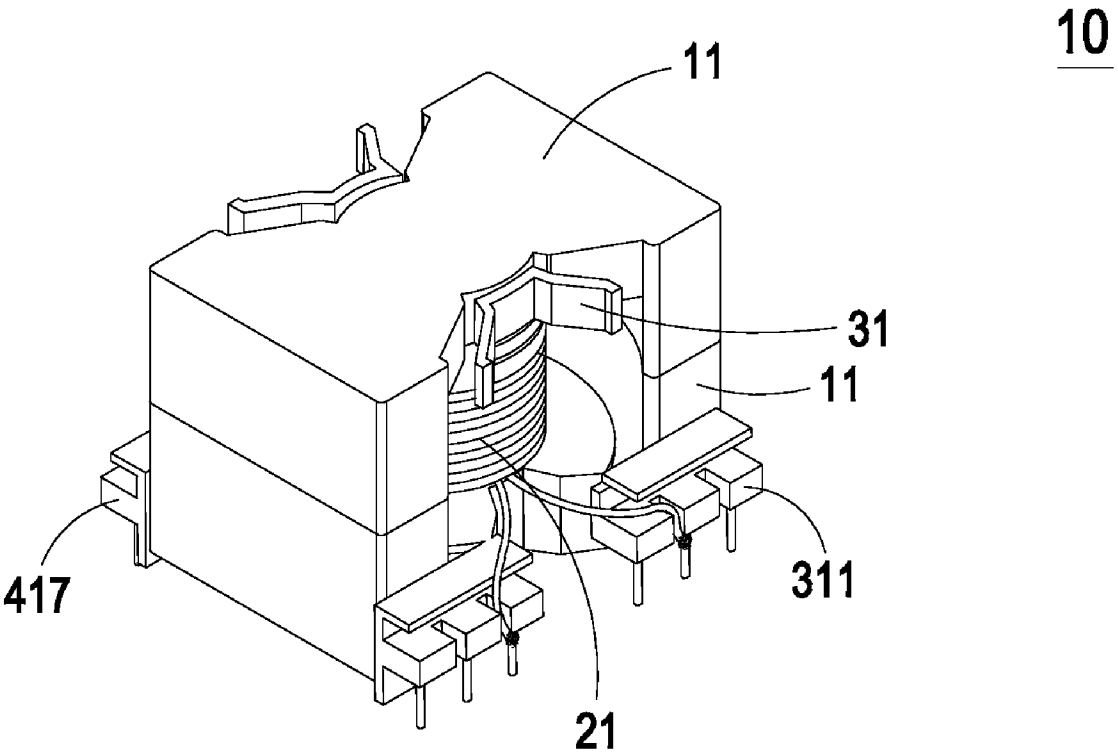
FIG. 2 PRIOR ART
FIG. 2 is an assembled view schematically showing the same as in FIG. 1.
Figure 3:
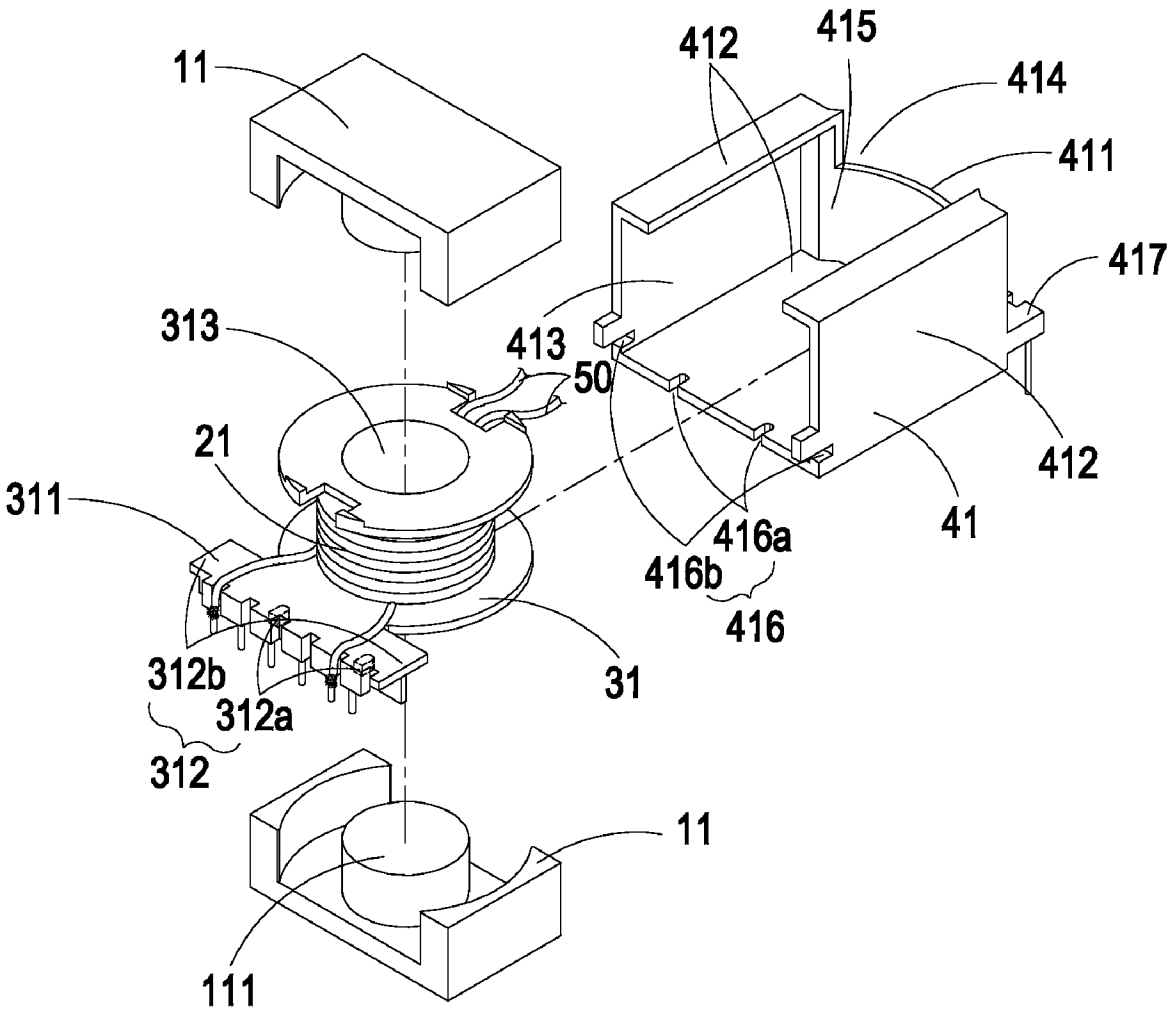
FIG. 3 is an exploded view schematically showing a transformer according to one embodiment of the invention.
Figure 4:
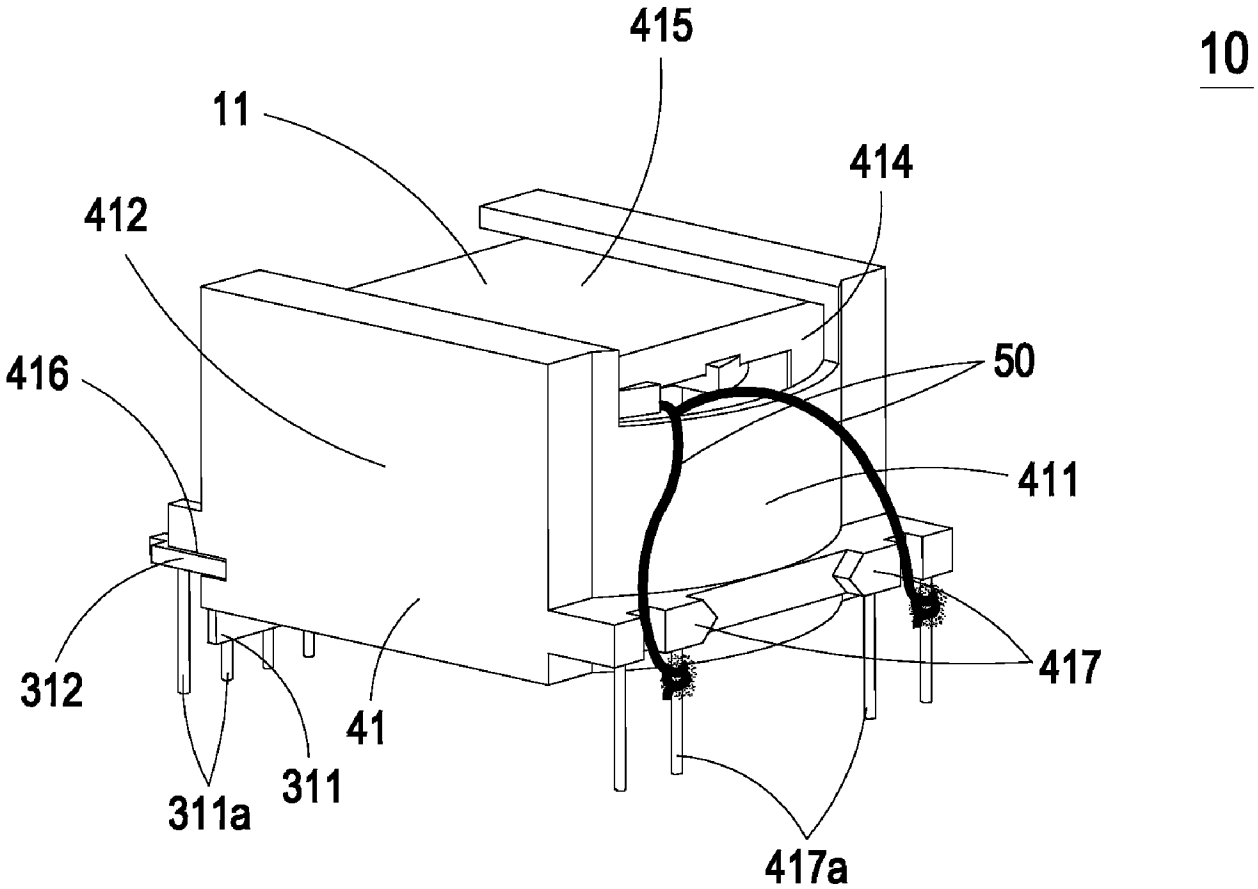
FIG. 4 is an assembled view schematically showing a transformer according to one embodiment of the invention.

FIG. 3 and FIG. 4 respectively illustrate an exploded and an assembled view schematically showing a transformer according to one embodiment of the invention. In this embodiment, the transformer 10 comprises a magnetic core 11, a winding coil 21 with a primary winding coil and a secondary winding coil, a bobbin 31 with a primary input port 311 and a bobbin connecting member 312, and an insulating slipcase 41. The bobbin 31 is mounted by the winding coil 21. The insulating slipcase 41 includes a first opening 413 to receive the magnetic core 11, the winding coil 21 and the bobbin 31, a first side wall 411, a second side wall 412 with a slipcase connecting member 416 which is engaged with the bobbin connecting member 312, and a secondary output port 417 for dealing with the output of the transformer 10. The first side wall 411 is placed oppositely to the first opening 413 and has a second opening 414 for the output of the secondary winding coil. As shown in FIG. 3, the first opening 413 is formed by substantially the whole of one side wall of the insulating slipcase 41. The second side wall 412 further comprises a third opening 415 which is communicated with the first opening 413 and the second opening 414. Some advantages can be obtained through the third opening 415, such as the heat dissipating, the performance testing, and the convenience in assembling. The insulating slipcase 41 is engaged with the bobbin 31 mounted by the winding coil 21 through the engagement between the slipcase connecting member 416 and the bobbin connecting member 312 so as to form the transformer 10. The primary input port 311 is for receiving the power and the secondary output port 417 is for supplying the power. The output of the secondary winding coil 50 is normally plural electrical wires being connected to the secondary output port 417. In one embodiment, the transformer is placed on a circuit board, and two ports are respectively connected to the same. On one end of each of the primary input port and the secondary output port place a plurality of pins 311*a*, 417*a*.

Figure 5:
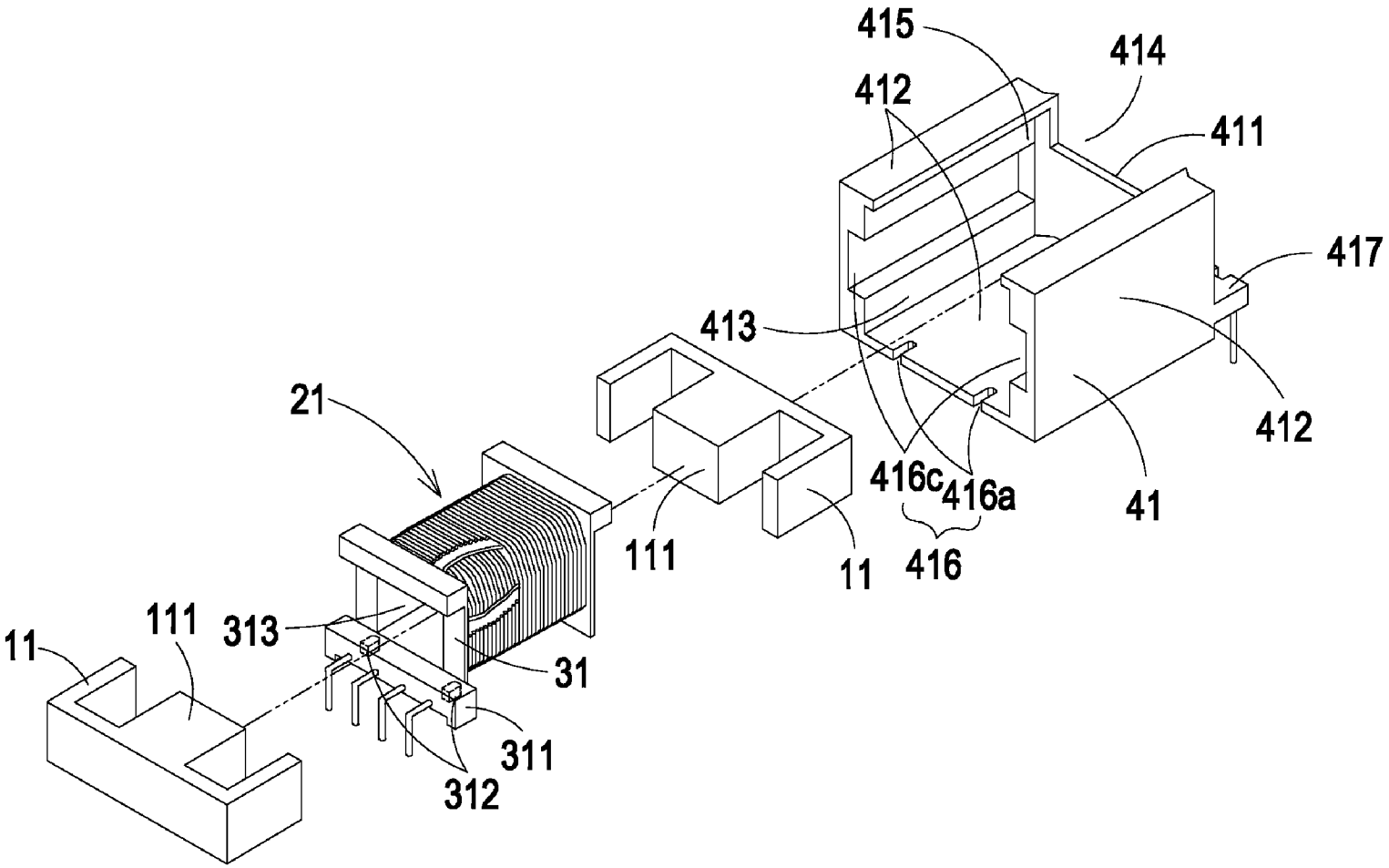
FIG. 5 shows an exploded view of a transformer according to another embodiment of the invention.

In this embodiment, the bobbin 31 comprises a perforation channel 313 to accommodate a central post 111, and the central post 111 is placed and accommodated vertically to the bobbin. However, it may be preferred to be placed horizontally in other cases, such as shown in FIG. 5. The bobbin connecting member 312 further has at least two engaging sets, and the slipcase connecting member 416 further has the same correspondingly. In one embodiment, the at least two engaging sets on the bobbin connecting member 312 include a first protrusion set 312*a* and a second protrusion set 312*b*, and the at least two engaging sets on the slipcase connecting member 416 include a first cave set 416*a* and a second cave set 416*b* to be symmetrically placed correspondingly, and to be engaged with, the first protrusion set 312*a* and the second protrusion set 312*b*. As shown in FIG. 3, the first protrusion set 312*a* is extended downwards from the primary input port 311, and the second protrusion set 312*b* is disposed on two opposite sides of the primary input port 311 and is extended outwards. The first cave set 416*a* and the second cave set 416*b* are placed, respectively in response to the first protrusion set 312*a* and the second protrusion set 312*b*, on the second side wall 412 adjacent to the first opening 413, wherein the two cave sets are placed vertically to each other. Accordingly, this arrangement enables the insulating slipcase 41 being engaged with the bobbin 31 when the first protrusion set 312*a* is engaged with the first cave set 416*a* and the second protrusion set 312*b* is engaged with the second cave set 416*b*.

In this embodiment, it is easily to be understood that the engagement type and the placement of the at least two sets respectively placed on the primary input port 311 and the insulating slipcase 41 which are illustrated in FIG. 3 may alternatively change, be reverse, or even change, be reverse within the same set, provided the engagement result between the bobbin 31 and the slipcase 41 has been achieved. In one embodiment, the magnetic core is a ferrite core, and is one of a PJ type, a PQ type, an EQ type, an RM type, an ER type, and a PM type in shape.

According to the foregoing description, the present invention has disclosed a transformer which is capable to improve the insulation of a transformer, solve the problems occurred in the conventional way, and suitable for a wild variety of electronic devices, such as a switching power supply.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising: a magnetic core;

a winding coil having a primary winding coil and a secondary winding coil;

a bobbin mounted by said winding coil, having a primary input port, and a bobbin connecting member; and an insulating slipcase including: a first opening to receive said magnetic core, said winding coil, and said bobbin; a first side wall opposite to said first opening and having a second opening for the output of said secondary winding coil; a second side wall having a slipcase connecting member engaged with said bobbin connecting member; and a secondary output port integrated with the insulating slipcase.

2. The transformer according to claim 1 wherein said bobbin comprises a perforation channel to accommodate a central post of said magnetic core.

3. The transformer according to claim 2 wherein said central post is accommodated by said perforation channel, and is placed vertically or horizontally to said bobbin.

4. The transformer according to claim 1 wherein said first opening is formed by substantially the whole of one side wall of said insulating slipcase.

5. The transformer according to claim 1 wherein said second side wall comprises a third opening communicated with said first opening and said second opening.

6. The transformer according to claim 1 wherein said bobbin connecting member comprises at least two engaging sets disposed on said primary input port.

7. The transformer according to claim 1 wherein said slipcase connecting member comprises at least two engaging sets symmetrically disposed on said second side wall adjacent to said first opening, wherein one set of said at least two engaging sets are placed vertically to another.

8. The transformer according to claim 1 wherein each of said primary input port and said secondary output port comprises a plurality of pins disposed on one end thereof.

9. The transformer according to claim 1 wherein said magnetic core is a ferrite core, and is one of a PJ type, a PQ type, an EQ type, an RM type, an ER type, and a PM type in shape.

10. The transformer according to claim 1 wherein said transformer is for use in a switching power supply.

11. A method for making a transformer, comprising the steps of: forming a winding coil having a primary winding coil and a secondary winding coil; forming a bobbin having a primary input port and a bobbin connecting member; setting said winding coil around said bobbin; incorporating said bobbin with a magnetic core; forming an insulating slipcase having a first opening, a first side wall opposite to said first opening and having a second opening for the output of said secondary winding coil, a second side wall having a slipcase connecting member, and a secondary output port integrated with the insulating slipcase; accommodating said magnetic core, said winding coil, and said bobbin in said insulating slipcase through said first opening; and engaging said slipcase connecting member with said bobbin connecting member.

12. The method according to claim 11 wherein said bobbin comprises a perforation channel to accommodate a central post of said magnetic core.

13. The method according to claim 12 wherein said central post is accommodated by said perforation channel, and is placed vertically or horizontally to said bobbin.

14. The method according to claim 11 wherein said first opening is formed by substantially the whole of one side wall of said insulating slipcase.

15. The method according to claim 11 wherein said second side wall comprises a third opening communicated with said first opening and said second opening.

16. The method according to claim 11 wherein said bobbin connecting member comprises at least two engaging sets disposed on said primary input port.

17. The method according to claim 11 wherein said slipcase connecting member comprises at least two engaging sets symmetrically disposed on said second side wall adjacent to said first opening, wherein one set of said at least two engaging sets is placed vertically to another.

18. The method according to claim 11 wherein each of said primary input port and said secondary output port comprises a plurality of pins disposed on one end thereof.

19. The method according to claim 11 wherein said magnetic core is a ferrite core, and is one of a PJ type, a PQ type, an EQ type, an RM type, an ER type, and a PM type in shape.

* * * * *